United States Patent [19]

Mizelle

[11] 4,238,861

[45] Dec. 16, 1980

[54] BOX SPRING ASSEMBLY WITH LIMITED DEFLECTION FORMED WIRE SPRINGS

[75] Inventor: Ned W. Mizelle, Lexington, Ky.

[73] Assignee: Hoover Universal, Inc., Saline, Mich.

[21] Appl. No.: 38,536

[22] Filed: May 14, 1979

[51] Int. Cl.[3] ..... A47C 23/02; A47C 23/00

[52] U.S. Cl. ..... 5/247; 5/255

[58] Field of Search ..... 5/247, 255, 476, 246; 267/107

[56] References Cited

U.S. PATENT DOCUMENTS

| | | | |
|---|---|---|---|
| 3,487,480 | 1/1970 | Slominski | 5/476 |
| 3,852,838 | 12/1974 | Slominski et al. | 5/247 |
| 4,129,908 | 12/1978 | Wagner | 5/247 |

*Primary Examiner*—Roy D. Frazier
*Assistant Examiner*—Alexander Grosz
*Attorney, Agent, or Firm*—Olsen and Stephenson

[57] ABSTRACT

A box spring assembly which includes a generally rectangular frame and a plurality of wire springs mounted on the frame and connected to each other so as to yieldably resist downwardly directed bedding loads. Each of the springs has an elongated body portion arranged above the frame and downwardly extending end portions, each of the end portions having a lower column section consisting of a straight length of spring wire and an upper section consisting of a plurality of substantially horizontal torsion bars and a plurality of angularly arranged connecting bars connected to and extending between the torsion bars so that in response to a downwardly directed bedding load, the upper section will yieldably collapse to accommodate the load and impart a feeling of soft support to the bedding user. Subsequently, the straight wire column carries the bedding load and imparts a feeling of firm support to the bedding user. This combination of initial softness and subsequent firmness is desirable in bedding foundations for purposes of user comfort.

8 Claims, 7 Drawing Figures

BOX SPRING ASSEMBLY WITH LIMITED DEFLECTION FORMED WIRE SPRINGS

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; and 3,852,838. Box spring assemblies of the general type shown in the above list of patents, all of which are assigned to the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly and cost of manufacture.

Additional box spring assemblies of this general type are shown in U.S. Pat. Nos. 3,596,299; 3,722,013; 3,825,960; 3,833,948; 3,835,485; 3,869,740; 3,990,121; and 4,000,531.

The present invention provides a box spring assembly which utilizes a different spring from the formed wire springs utilized in the patented box spring assemblies discussed above. The spring in the present box spring assembly has an upper portion which yieldably collapses under load to impart a feeling of softness when the bedding occupant first reclines on a mattress supported on the box spring assembly of this invention. This collapse of the upper section is accompanied by a fast build up of resistance to load to reduce the chance of excessive deflection. The upper section then "bottoms out" meaning that it reaches a position in which it cannot yield or collapse any further. All of the bedding load is then carried by the lower section of the spring which consists principally of an upright length of straight spring wire which functions as a column to support the bedding load. The column is substantially unyielding, thus imparting a feeling of firm support to the bedding user following the initial feeling of softness. This combination of initial softness and subsequent firmness is desirable in bedding foundations for reasons of user comfort; the load-carrying capability of the spring being much greater than the initial soft feel would indicate to the user. The lower section also includes a torsion bar which enables some yielding of the lower section to prevent the lower section from taking a set.

It is an object of the present invention, therefore, to provide an improved box spring assembly having limited deflection formed wire springs capable of imparting the desired feeling of comfort to the bedding user.

SUMMARY OF THE INVENTION

The box spring assembly of this invention consists of a generally horizontal rectangular frame and a plurality of wire springs mounted on the frame and connected to each other so as to yieldably resist downwardly directed bedding loads, each of the springs being formed of spring steel wire having an elongated body portion arranged above the frame and downwardly extending end portions secured to the frame. Each of the spring end portions has an upper section consisting of a plurality of substantially horizontal torsion bars and a plurality of angularly arranged connecting bars connected to and extending between the torsion bars so that the upper section can yieldably collapse when subjected to a downwardly directed bedding load. Each spring end section also has a lower section consisting of a straight length of spring wire forming a column formed integral at the upper end with the upper section of the spring and formed integral at its lower end with a torsion bar secured to the frame.

The wire springs in the box spring assembly of this invention are termed "limited deflection" springs because the upper sections of the spring end portions will yieldably collapse only to a point. At this point, the normally vertically spaced lengths of wire in the upper section come together and "bottom out" on each other so that the upper section cannot yield any further. The lower section functions much like a column and is thus able to withstand high bedding loads without deflection. As a result, deflection of each spring is generally limited to the amount of deflection that will take place in the upper spring sections before they "bottom out". Subsequently, the only deflection that can take place is due to twisting of the frame-mounted torsion bar at the lower end of each spring end section.

Springs constructed in accordance with this invention impart a high degree of comfort to bedding users reclined on mattresses supported on the box spring assemblies of this invention. This is due to the fact that the springs of this invention impart a desired feeling of initial softness to the bedding user to give the user a feeling of soft support. Once the user is fully supported on the mattress, the column-type lower sections of the spring end portions in this invention give a feeling of firm, solid, reliable support to the box spring assembly which is highly desirable from the standpoint of one reclining on a mattress supported on the box spring assembly. To such a user, the feeling that the mattress is firmly and reliably supported is of prime importance.

Accordingly, the principal object of the present invention is to provide an improved formed wire box spring assembly that is advantageous from the standpoint of user comfort and reliability.

Further objects, features, and advantages of this invention will become apparent from a consideration of the following description, the appended claims, and the accompanying drawing in which:

Figure 1:
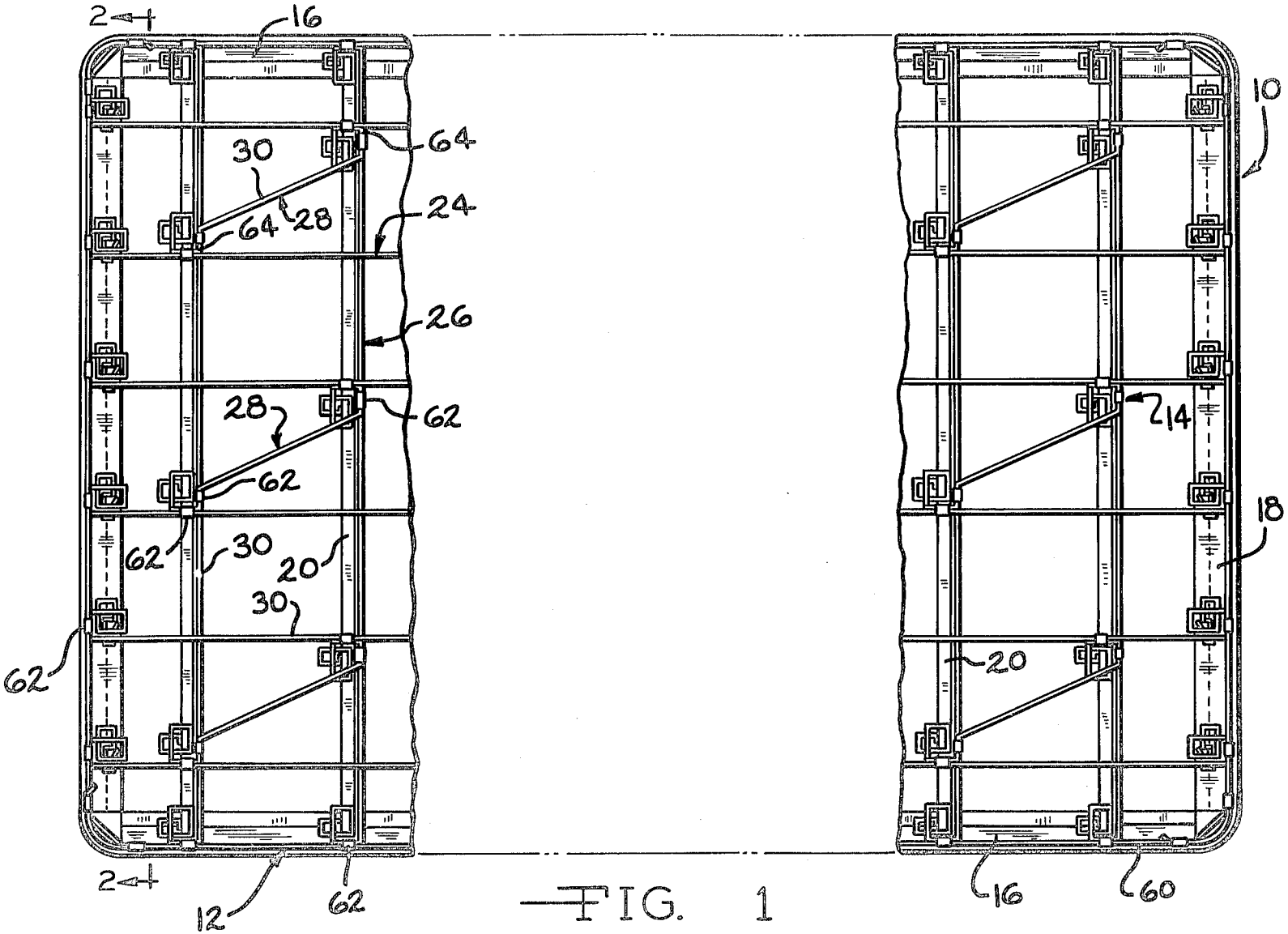
FIG. 1 is a plan view of the box spring assembly of this invention with the middle portion of the spring assembly being broken away for ease of illustration.

With reference to the drawing, the spring assembly of this invention indicated generally at 10, is illustrated in FIG. 1 as consisting of a generally rectangular horizontally disposed frame 12, usually formed of wood, and a wire spring assemblage 14 mounted on the top side of the frame 12. The frame 12 has side rails 16, end rails 18, and cross rails 20 which are secured to and extend between the side rails 16.

The spring assemblage 14 consists of a plurality of first main springs 24 which extend longitudinally of the frame 12 and a plurality of second main springs 26, which extend transversely of the main frame 12. The main springs 24 and 26 are supported intermediate their ends by intermediate springs 28. All of the springs 24, 26, and 28 are formed of spring steel wire and are substantially identical in that each has a generally horizontal body portion located above the frame 12 and a pair of depending end portions which are mounted on the frame 12. Accordingly, only a main spring is illustrated in detail in FIGS. 3, 4, and 5 and only a main spring will be described in detail hereinafter with like numerals indicating like parts on the springs 24, 26, and 28.

Figure 2:
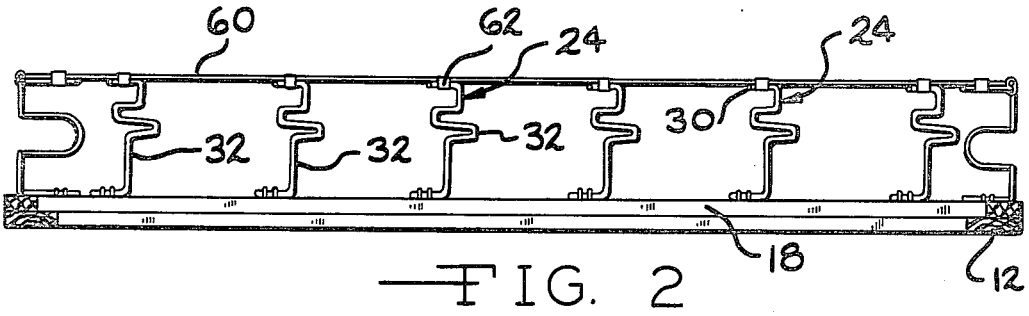
FIG. 2 is a transverse sectional view of the box spring assembly of this invention as seen from substantially the line 2—2 in FIG. 1.
Figure 3:
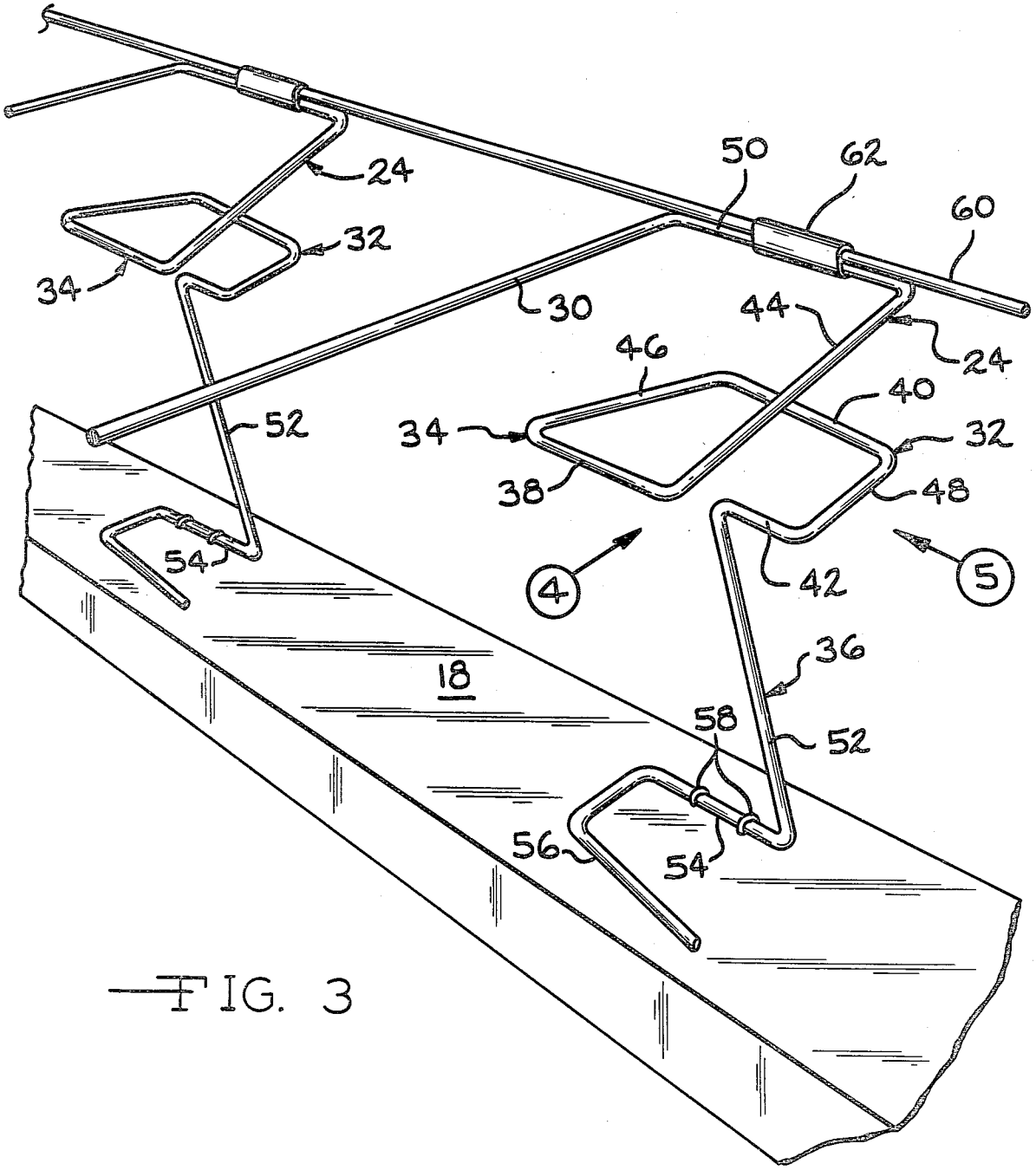
FIG. 3 is a fragmentary prospective view of a portion of the box spring assembly shown in FIG. 1.

As shown in FIGS. 1, 2, and 3, the spring 24 includes a generally horizontal body portion 30 disposed above the frame 12 a distance corresponding to the desired height of the box spring assembly 10, this height normally being the standard height for box springs in the bedding industry. A pair of yieldable end portions 32 extend downwardly from the ends of the body portion 30 and are secured to the frame 12. Each of the end portions 32 has an upper section 34 formed integral with one end of the body portion 30 and a lower section 36 which is supported on the frame 12.

The upper section 34 consists of a plurality of generally horizontal torsion bars 38, 40, and 42 and a plurality of angularly related connecting bars 44, 46, and 48 which are connected to and extend between the torsion bars 38, 40, and 42 as shown in FIG. 3. At its upper end, the section 34 includes a mounting bar 50 which connects the body portion 30 to the connecting bar 44. The lower section 36 consists principally of a generally upright straight length of wire 52 formed integral at its upper end with the torsion bar 42 and at its lower end with a mounting torsion bar 54 which extends transversely of the column 52 and is in longitudinal surface-to-surface contact with the end rail 18. A mounting foot 56 constitutes an extension of the torsion bar 54 and staples 58 are used to secure the torsion bar 54 to the end rail 18.

The spring assemblage 14 also includes, in addition to the main springs 24 and 26 and the intermediate springs 28, a border wire 60 which is generally rectangular in shape corresponding to the shape of the rectangular frame 12 and spaced a distance above the frame 12 corresponding to the desired height of the box spring assembly 10. The mounting bars 50 at the upper ends of the main springs 24 and 26 are disposed in a side-by-side relation with the border wire 60 and are secured to the border wire 60 by conventional wrap-around-type spring clips 62. Each intermediate spring 28 is secured to adjacent main springs 24 by wrap-around clips 62 extending about the mounting bars 50 at the ends of the spring 28 and the body portions 30 of the main springs 24. Each intermediate spring body portion 30 is formed at its ends with portions 64 that are at right angles to the mounting bars 50. These right angle portions are also secured by wrap-around clips 62 to the body portions 30 of adjacent main springs 26. The result is a rectangular spring deck consisting of the body portions 30 of the springs 24, 26, and 28 and the border wire 60 which is disposed in a horizontal plane above the frame 12 and supported on the spring end portions 32. The end portions 32 resiliently support the deck so that it can yield to bedding loads to accommodate the usual body supporting mattress (not shown) so that the mattress will impart the desired degree of sleeper comfort to the user.

The feet 56 at the ends of the main springs 24 are supported on the end rails 18 and secured thereto by the staples 58. The feet 56 at the ends of the main springs 26 are similarly supported on the side rails 16 and are secured thereto by similar staples (not shown). Likewise, the feet at the lower ends of the intermediate springs 28 are supported on the cross rails 20 and secured thereto by staples (not shown) like the staples 58.

Figure 4:
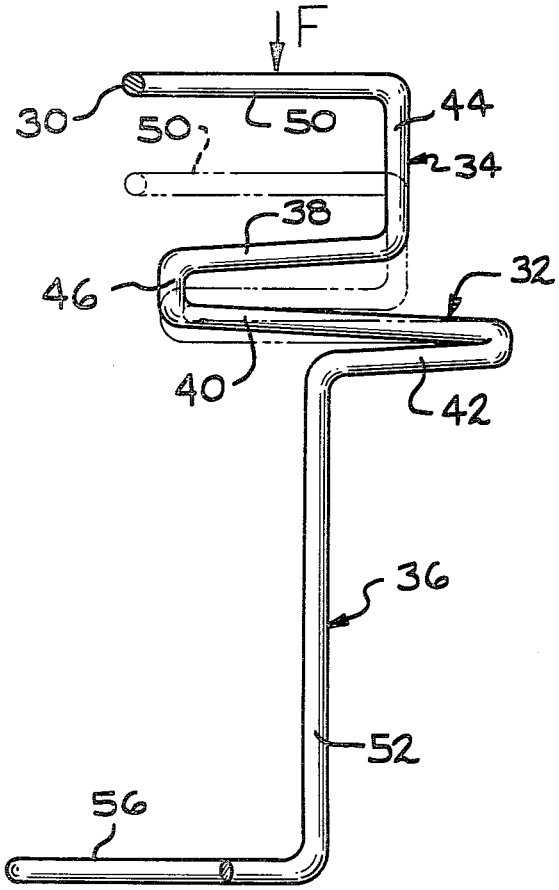
FIGS. 4 and 5 are elevational views of the end portion of the improved spring of this invention as seen from substantially the vantage point of the arrows indicated at 4 and 5, respectively, in FIG. 3, showing the spring end portion in an expanded position in solid lines and a partially deflected position in broken lines.
Figure 5:
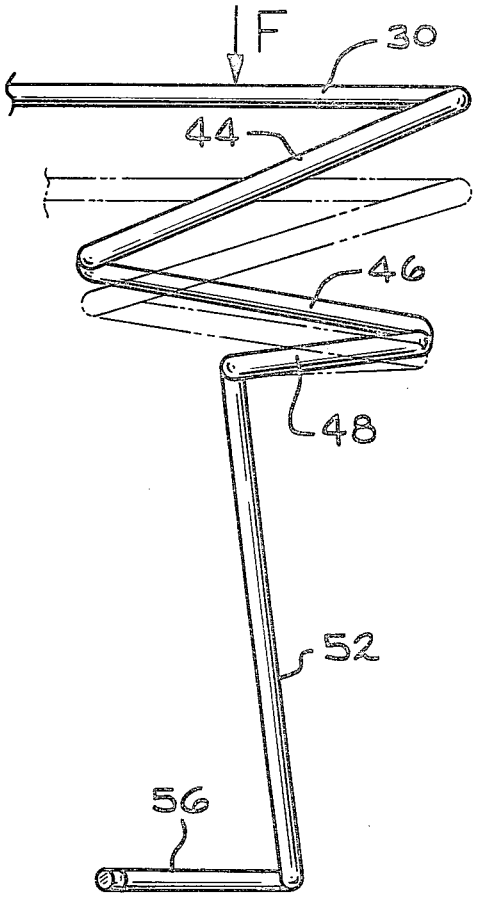

In the use of the box spring assembly 10, the loads applied by the mattress occupant will be downwardly directed loads such as indicated by the arrow F in FIGS. 4 and 5. The load F on the spring deck described above acts to downwardly deflect the spring end portions 32 on which the deck is supported, as shown in broken lines in FIGS. 4 and 5. During such deflection, the torsion bars 38, 40, and 42 in the upper section 34 are twisted and the inherent resistance of the torison bars to this twisting imparts the desired resilient resistance to the load F to preclude any feeling that the box spring assembly 10 is not providing the necessary support. However, the normal occupant load on the spring deck is adequate to twist the torsion bars 38, 40, and 42 so that the deck will yield and impart a feeling of softness to the mattress occupant.

Figure 6:
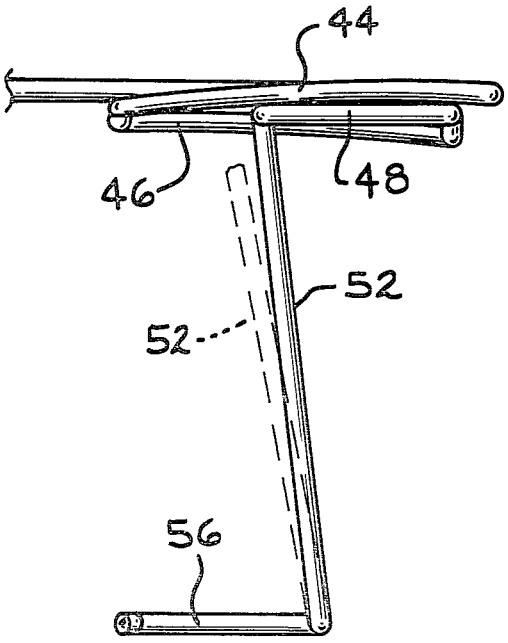
FIG. 6 is an elevational view, like FIG. 5, showing the spring in a substantially fully deflected position in full lines and illustrating in broken lines the capability of the spring to yieldably deflect slightly following bottoming out.
Figure 7:
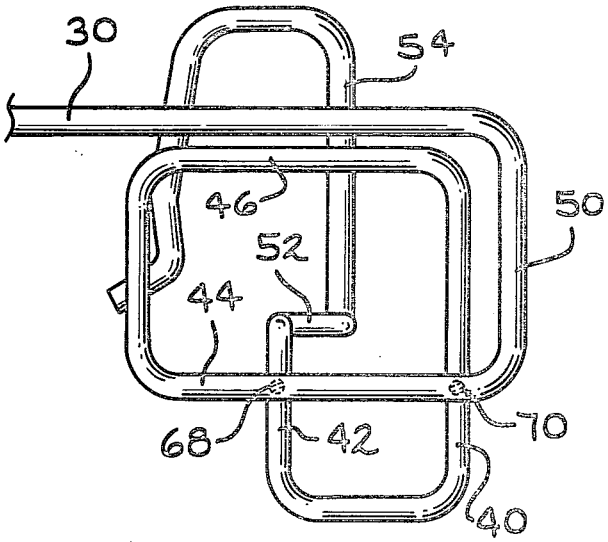
FIG. 7 is a fragmentary top view of the improved spring of this invention.

As the upper section 34 is progressively deflected or collapsed, as shown in broken lines in FIGS. 4 and 5, the resistance of the torsion bars 38, 40, and 42 to twisting increases rapidly to increase the feeling of firmness in the support of the box spring assembly 10 and reduce the chance of excessive spring deflection. If the load F is high enough, the upper spring section 34 will "bottom out" as shown in FIGS. 6 and 7. By "bottoming out", is meant that the torsion bars 40 and 42 are located in the path of the downwardly moving connecting bar 44 so that the connecting bar 44 will engage the torsion bars 40 and 42 at the points indicated in phantom lines 68 and 70 in FIG. 7. Once the upper section 34 has "bottomed out", it cannot collapse any further and all of the bedding load is now transmitted directly to the column 52 which, by virtue of its being a generally upright length of wire is practically unyielding. This imparts a very firm or stiff feeling to the formed wire box spring assembly 10.

By virtue of the mounting of the lower end of the column 52 on the torsion bar 54, the column 52 can incline further as shown in broken lines in FIG. 6 to twist the torsion bar 54 and give added yieldability to the spring assemblage 14. When the load is released on the spring deck, the spring end portions 32 will expand to their solid line positions shown in FIGS. 4 and 5.

From the above description, it is seen that this invention provides an improved formed wire box spring assembly which includes the limited deflection springs 24, 26, and 28. The springs are structured so as to impart a desired feeling of comfort and reliable support to the box spring user. The result is a spring deck consisting of the body portions 30 of the springs 24, 26, and 28 and bounded by the border wire 52 which is disposed in a horizontal plane above the frame 12 and supported on the spring end portions 32. The end portions 32 resiliently support the deck so that it can yield under bedding loads to accommodate the usual body-supporting mattress (not shown) so that the mattress will impart the desired degree of sleeper comfort.

What is claimed:

1. In a box spring assembly which includes a generally rectangular frame, a plurality of limited deflection wire springs mounted on said frame and connected to each other so as to yieldably resist downwardly directed bedding loads, each of said springs being formed of spring steel wire and having an elongated body portion arranged above said frame and downwardly extending end portions, each of said end portions having an upper section and a lower section, said upper section comprising a plurality of substantially horizontal torsion bars and a plurality of angularly arranged connecting bars connected to and extending between said torsion bars, said torsion bars being movable in response to torsional stressing thereof to enable downward yieldable collapsing deflection of said upper section, said torsion bars and connecting bars in said upper section being relatively arranged so that the upper one of said connecting bars engages the lower one of said torsion bars in the fully deflected condition of said upper section, said lower section comprising an an upwardly extending column of wire, and means mounting said column on said frame.

2. The structure according to claim 1 wherein said lower one of said torsion bars in said upper section is located at the upper end of said column and extends transversely thereof.

3. The structure according to claim 1 further including a border wire of generally rectangular shape disposed above and in general alignment with said rectangular frame, mounting bars at the upper ends of the end portions for at least some of said springs arranged side by side with said border wire, and wrap-around clip means connecting said mounting bars to said border wires.

4. The structure according to claim 3 further including torsion bars formed integral with the lower ends of said columns and positioned in engagement lengthwise thereof with said frame, and means maintaining said torsion bars in said engagement with said frame.

5. In a box spring assembly which includes a generally rectangular frame, a plurality of limited deflection wire springs mounted on said frame and connected to each other so as to yieldably resist downwardly directed bedding loads applied to said springs, each of said springs being formed of spring steel wire and having an elongated body portion arranged above said frame and downwardly extending end portions, each of said end portions having a lower column section extending upwardly from said frame, and a yieldably collapsible section formed integral with and extending between said body portion and the upper end of said column section, said upper section including a plurality of substantially horizontal torsion bars and a plurality of angularly arranged connecting bars connected to and extending between said torsion bars, the lower two of said torsion bars being located below and in the path of movement of the upper one of said connecting bars during downward collapsing movement of said upper section, so that engagement of said upper connecting bar with said lower torsion bars limits deflection of the upper section in each of said springs.

6. The structure according to claim 5 further including a torsion bar formed integral with the lower end of said column section and positioned in engagement lengthwise thereof with said frame, and means securing said torsion bar to said frame.

7. A wire spring for a box spring assembly, said spring being formed of a single strip of spring steel wire and comprising an elongated generally horizontal body portion having downwardly extending end portions, each of said end portions having a lower column section consisting of an upwardly extending length of substantially straight wire and a yieldably collapsible section extending upwardly from the upper end of said lower section, said upper section including a plurality of substantially horizontal torsion bars and a plurality of angularly arranged connecting bars connected to and extending between said torsion bars, the lower two of said torsion bars being located below and in the path of movement of the upper one of said connecting bars during downward collapsing movement of said upper section, so that engagement of said upper connecting bar with said lower torsion bars limits deflection of said upper section, the lower one of said torsion bars extending transversely from the upper end of said column section and being located in a vertical plane disposed between the vertical planes in which the upper one of said torsion bars is located and the vertical plane in which the other one of said lower two torsion bars is located.

8. The structure according to claim 7 further including a torsion bar extending transversely of the lower end of said column section, said length of straight wire being inclined in one direction with respect to a vertical plane at a position such that further inclination of said straight wire in said one direction will result in twisting of said torsion bar.

* * * * *